US008893905B2

(12) United States Patent
Stührwoldt

(10) Patent No.: US 8,893,905 B2
(45) Date of Patent: Nov. 25, 2014

(54) TELESCOPING SYSTEM FOR CRANE JIB AND AUXILIARY JIB

(75) Inventor: Dieter Stührwoldt, Wilhelmshaven (DE)

(73) Assignee: Manitowoc Crane Group France SAS, Dardilly Cedex (FR)

( * ) Notice: Subject to any disclaimer, the term of this patent is extended or adjusted under 35 U.S.C. 154(b) by 275 days.

(21) Appl. No.: 13/328,813

(22) Filed: Dec. 16, 2011

(65) Prior Publication Data

US 2012/0152880 A1 Jun. 21, 2012

(30) Foreign Application Priority Data

Dec. 17, 2010 (EP) ..... 10195540

(51) Int. Cl.
*B66C 23/04* (2006.01)
*B66C 23/70* (2006.01)

(52) U.S. Cl.
CPC ..... *B66C 23/708* (2013.01)
USPC ..... 212/349; 212/348; 212/350

(58) Field of Classification Search
USPC ..... 212/292, 177, 347–349; 52/118
See application file for complete search history.

(56) References Cited

U.S. PATENT DOCUMENTS 5,597,078 A * 1/1997 Becker et al. ..... 212/231
6,189,712 B1 2/2001 Conrad et al.
6,527,131 B1 3/2003 Bröckelmann et al.
7,341,157 B2 * 3/2008 Slobogean et al. ..... 212/250
8,215,503 B2 * 7/2012 Appel et al. ..... 212/349

FOREIGN PATENT DOCUMENTS

| | | |
|---|---|---|
| DE | 19824672 | 12/1998 |
| DE | 20003555 | 8/2000 |
| DE | 10142847 | 11/2002 |
| DE | 102008034676 | 4/2010 |
| EP | 0943580 | 9/1999 |
| EP | 1321427 | 6/2003 |
| JP | 11-035284 | 2/1999 |

OTHER PUBLICATIONS

European Search Report on EP10195540, dated May 19, 2011.
JP office action issued Mar. 4, 2014, for related JP Application No. 2011-259042, with English translation.

* cited by examiner

*Primary Examiner* — Emmanuel M Marcelo
*Assistant Examiner* — Angela Caligiuri
(74) *Attorney, Agent, or Firm* — John C. Bacoch; Brinks Gilson & Lione

(57) ABSTRACT

A crane jib system having a main jib, an auxiliary jib, and a telescoping cylinder. The main jib is comprised of main telescoping portions and the auxiliary jib is attached to the main jib and comprises auxiliary telescoping portions. The telescoping cylinder has a first telescopic part locking unit disposed on a base portion of the telescoping cylinder. The first telescopic locking unit is adapted to selectively engage the main telescoping portions. A second telescopic part locking unit is disposed on the telescoping cylinder above the first telescopic part locking unit. The second telescopic part locking unit is adapted to selectively engage the auxiliary telescoping portions.

20 Claims, 4 Drawing Sheets

TELESCOPING SYSTEM FOR CRANE JIB AND AUXILIARY JIB

REFERENCE TO EARLIER FILED APPLICATION

This application claims the benefit of the filing date of European Patent Application Number 10 195 540.9, filed Dec. 17, 2010, the disclosure of which is incorporated, in its entirety, by this reference.

FIELD

The present application relates to the field of crane jibs and more particularly to systems for telescoping crane jibs.

BACKGROUND

Telescoping systems with a telescoping cylinder for crane jibs are basically known. For example, a telescoping system is described in EP 943 580 B1. Therein, the telescoping cylinder serves for extending and retracting the telescopic parts or sections of the main jib.

It is also already known to connect auxiliary jibs to the main jib of such cranes. In mobile cranes or vehicle cranes, in which the application of the present invention is particularly useful, luffing jibs often are attached to a forward most section of the main jib in order to achieve additional height or range. Because such luffing jibs are mostly formed as grid parts, assembled on ground, and then aligned by the main jib, there is disadvantageously a high space requirement for crane assembly. There also exists telescopic auxiliary jibs with their own telescoping system or telescoping cylinder, however, such systems have low payload capacity due to their own high weight. Sometimes, in large cranes additional telescopic parts, which are only provided at the construction site, are inserted into the main jib in order to provide a longer jib. Herein, the disadvantage is in that the additional telescopic sections have to be smaller than the last telescoping segment in the main jib and the guide or slide pieces have to be taken into account upon assembly.

As to this background, it is the object of the present invention to provide a crane jib telescoping system and a crane jib system, respectively, which overcome the disadvantages of the above mentioned implementations according to the prior art. In particular, a high payload can be realized with a range or achievable height as large as possible.

SUMMARY

The present embodiments provide for a crane jib system for telescoping an auxiliary jib. In one embodiment the crane jib system includes a main jib comprised of main telescoping portions, an auxiliary jib attached to the main jib, the auxiliary jib compromised of auxiliary telescoping portions, and a telescoping cylinder. The telescoping cylinder has a first telescopic part locking unit disposed on a base portion of the telescoping cylinder with the first telescopic locking unit adapted to selectively engage the main telescoping portions. A second telescopic part locking unit is disposed on the telescoping cylinder above the first telescopic part locking unit with the second telescopic part locking unit adapted to selectively engage the auxiliary telescoping portions.

In another embodiment, a crane jib telescoping system is adapted to telescope a crane jib having a telescopic main jib comprised of main telescoping portions and a telescopic auxiliary jib attached to the main jib compromised of auxiliary telescoping portions. The crane jib telescoping system includes a telescoping cylinder having a first telescopic part locking unit disposed on a base portion of the telescoping cylinder with the first telescopic locking unit adapted to selectively engage the main telescoping portions. A second telescopic part locking unit is disposed on the telescoping cylinder above the first telescopic part locking unit and the second telescopic part locking unit is adapted to selectively engage the auxiliary telescoping portions.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

Figure 1:
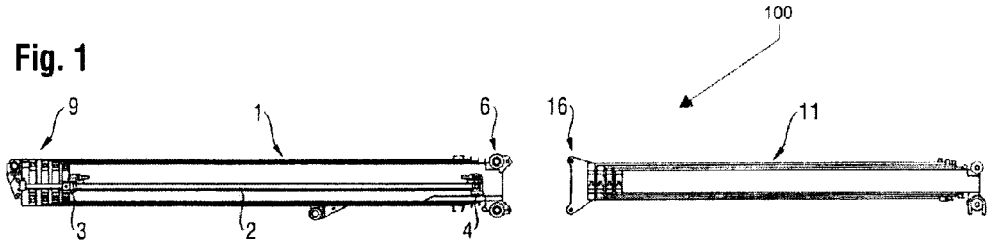
FIG. 1 is a cross-sectional view of crane jib system in accordance with embodiments of the present invention.

The drawings are not necessarily to scale.

DETAILED DESCRIPTION

The present invention provides a crane jib telescoping system and a crane jib system, respectively, which overcome the disadvantages of the above mentioned implementations according to the prior art. In particular, a high payload can be realized with a range or achievable height as large as possible. Overcoming the disadvantages of the prior art is solved by a crane jib telescoping system as well as a crane jib system.

The invention with respect to the telescoping system is suitable and intended for crane jibs having a main jib and an auxiliary jib, however, its scope is not limited to systems having such jibs. Rather, the telescoping system is to be considered as a distinctive, independent invention, which basically can be constructed or provided isolated without crane main jibs and crane auxiliary jibs being provided.

In the telescoping system according to the present invention, a second telescopic part locking unit is disposed on the telescoping cylinder above the first telescopic part locking unit. In other words, the telescoping cylinder according to the present invention supports not only the locking unit for the main jib, but an additional locking unit for the auxiliary jib, i.e. a single telescoping cylinder can be used to telescope two jibs. Thus, the telescopic crane jib can be provided with an auxiliary jib, which can be telescoped out and in by means of the telescoping system or telescoping mechanism of the main jib, respectively. A telescoping auxiliary jib can be attached to a mobile crane without its own telescoping system and be used, which inherently already entails a great synergy effect. The saving of a separate telescoping mechanism for an auxiliary jib thus results in high cost savings.

However, except for the mentioned savings in manufacturing costs and constructional effort, there are important advantages with respect to the payload to be achieved and the achievable height and/or range. Modern mobile cranes, in which the present invention can be employed particularly advantageously (although of course stationary telescoping cranes can also be equipped according to the invention), are employed for lifting increasingly heavier loads to increasingly greater heights. Similarly, there are increases in the requirement to employ a more powerful mobile crane with a weight as low as possible, in order to save costs and logistics. Further, it is sought to provide a mobile crane with a payload as high as possible on as few axles as possible within the allowable axle loads, which beneficially affects the maneuverability on the one hand and keeps the overall costs of the crane low on the other hand.

The invention satisfy all of these requirements, because it crucially improves the telescopic jib, the core element of the mobile crane, which determines the maximum height and payload, and above all keeps the weight thereof low. Namely, if only a single telescoping cylinder has to be provided, which operates both the telescopic sections of the main jib and the telescopic sections of an auxiliary jib, the weight saved on the unnecessary telescoping mechanism for the auxiliary jib, can be used as the payload. Herein, the saved weight immediately increases the payload to the same extent. However, the option to convert the saved weight partially or totally to a longer auxiliary jib in order to thus increase the achievable height and range, respectively, is also available.

There are various possibilities according to the present invention to perform the placement of the second locking unit on the telescoping cylinder. The "range" for the telescoping system by means of the second locking unit will depend on the positioning of the second locking unit on the telescoping cylinder on the one hand and the length of the telescoping cylinder on the other hand. However, basically, the second locking unit will be disposed above the first locking unit, thus for example in the upper portion of the telescoping cylinder, in particular in its upper half. The attachment of the locking unit in the region of the end opposite the base portion or on the top part or at the upper end of the telescoping cylinder is possible and provided according to the invention in various embodiments.

A crane jib telescoping system according to the invention can be configured such that it only has a single telescoping cylinder; however, it is also possible in quite advantageous embodiments to provide two or more than two telescoping cylinders, wherein at least one of the telescoping cylinders has two locking units. The telescoping cylinders can be provided next to or above each other or parallel to each other in the main jib, and it is possible to provide a telescoping cylinder with only one locking unit for telescoping out and telescoping in the main jib, respectively, as well as an additional or several additional telescoping cylinders with two locking units provided for telescoping out and telescoping in the main and the auxiliary jib, respectively. With such an embodiment, it becomes possible to telescope the main jib concurrently with two or more cylinders, wherein a relatively large force can be exerted. The telescoping cylinder with only one locking unit, which would be provided only for the main jib, could then be a larger cylinder. A telescoping cylinder, in particular one that is configured small, could then be used for telescoping the main and auxiliary jibs as already discussed above.

A further aspect of the present invention relates to the overall larger unit, thus a crane jib system with a telescopic main jib and a telescopic auxiliary jib as well as with a telescoping system as it is described herein in various embodiments. With the second telescopic part locking unit, the auxiliary jib is telescoped in and out.

In the connection region between the main jib and the auxiliary jib, a passage can be present and be used or provided through which the upper portion of the telescoping cylinder with the second locking unit can move into the auxiliary jib. In other words, the second locking unit is moved past the head of the main jib in order to thus be able to be connected to the auxiliary jib. Thus, in such an embodiment, the telescoping cylinder is configured such that it is capable of moving through the head piece of the main jib due to its length, and of connecting to the auxiliary jib by means of the second locking unit, and then of extending or retracting it.

Thus the first and/or the second locking units are configured or disposed such that they are able to engage with points of application or portions of application in the lower end regions of the main and auxiliary jibs, in particular with points of application in the lower collar region.

As already indicated above, the construction according to the invention can provide room to the designer to meet particular requirements to the crane to be established individually or in combination. Thus, the reachability of the auxiliary jib and the achievable telescoping distance of the auxiliary jib are achieved or determined by a sufficient length of the telescoping cylinder or the position of the second locking unit, in particular the vicinity to the upper end of the telescoping cylinder, or by a combination of these properties. Here, the designer is at liberty to utilize the present invention according to his functional specification, and in some cases, a large achievable telescoping distance may be the goal. On the other hand, shorter telescoping cylinders can also save weight at the level of the jib and thus again allow for higher payloads.

In one embodiment of the present invention, the upper end of the telescoping cylinder extends up to the upper end region of the main jib in its retracted state, thereby achieving a relatively large telescoping range.

Within the scope of the present invention it is possible to attach the auxiliary jib to luffing jib pivot points of the main jib head such that the attachment means available here anyway can be optimally utilized. The invention contributes to this optimization of the attachment means by not impeding the attachment of the luffing jib by provision of its own telescoping mechanism elements for the auxiliary jib.

Furthermore, the invention is explained in more detail based on embodiments and with reference to the attached drawings. It can include all of the features described herein individually as well as in any reasonable combination, in particular it can be realized solely by a telescoping cylinder with two locking units or also by a main jib with a telescoping system according to the invention, but to which an auxiliary jib does not yet have to be mounted.

In the drawings, FIGS. 1 to 8 show a crane jib system 100 according to the present invention with a telescoping system according to the invention, wherein the telescoping operation for individual sections of the auxiliary and main jib, respectively, is progressively illustrated in the individual figures. FIG. 9 shows an embodiment of a crane jib telescoping system 200 with two telescoping cylinders.

The crane jib system 100 illustrated in FIG. 1 as well as in the remaining figures includes a main jib 1 and an auxiliary jib 11. The main jib 1 is pivotally attached (not illustrated here) on its base 9 to the upper structure of a crane (not illustrated), in particular an upper structure of a mobile or vehicle crane, and it includes four extendable telescopic sections besides its outer fundamental or base portion, which are not individually designated in FIG. 1. The auxiliary jib 11 also includes four extendable telescopic sections. As shown in FIG. 1, attachment element 6 is on a head of the inner telescopic section of the main jib and attachment element 16 is on a foot of the outer telescope section of the auxiliary jib 11. Incidentally, the attachment elements 6 are the same attachment elements as are used for example to attach a luffing jib to the main jib 1.

Further, in FIG. 1, a telescoping cylinder 2 is shown, which includes a first locking unit 3 for the telescopic parts of the main jib 1 on its left or base portion, as well as a second locking unit 4 for the telescopic parts of the auxiliary jib 11 at its right end.

Figure 2:
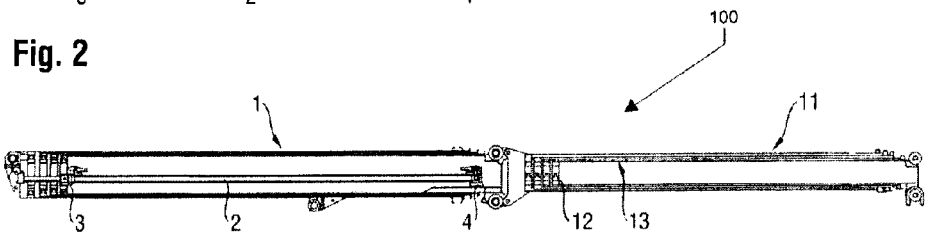
FIG. 2 is a cross-sectional view of the crane jib system of FIG. 1 showing the main jib connected to the auxiliary jib.

In the state shown in FIG. 2, the auxiliary jib 11 has been attached to the main jib 1 via the attachments 6, 16, and because it is best seen here, the lower locking unit portion 12 of the innermost telescopic part of the auxiliary jib 11 is revealed with the reference character 12.

Figure 3:
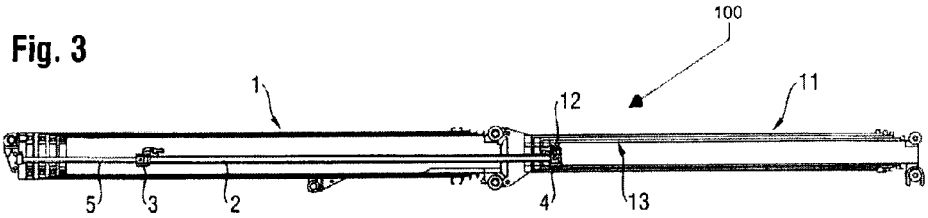
FIG. 3 is a cross-sectional view of the crane jib system of FIG. 1 showing a telescoping cylinder partially extended.

Starting with FIG. 3, telescoping out is described. In the illustrated embodiment, the extension of the telescopic parts of the auxiliary jib 11 will be effected before telescoping out the main jib 1 using the system. Unless otherwise indicated, the extension of the telescopic parts occurs according to already known and proven principles. In FIG. 3, it is seen that the telescoping cylinder 2 has shifted to the right on its piston 5 up to a point at which the second locking unit 4 engages with the lower locking unit portion 12 and thus locks the innermost section 13 of the auxiliary jib 11 for transport. In FIG. 3, it also becomes clear that the main jib 1 on its head piece as well as the auxiliary jib 11 on its foot piece are continuously constructed inside such that the front part of the telescoping cylinder 2 with the second locking unit 4 can pass through. The innermost telescopic part of the auxiliary jib 11 designated by 13 in the FIGS. 2 and 3 is thus fixedly connected to the locking unit 4, whereupon the extension is effected, which is seen in FIG. 4.

Figure 4:
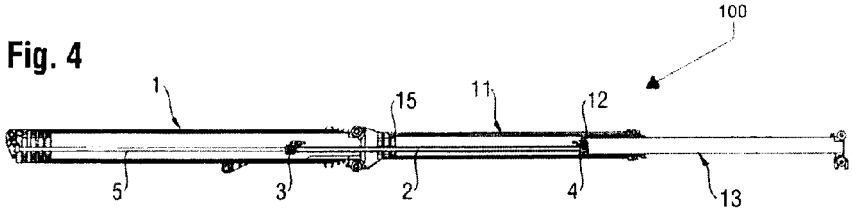
FIG. 4 is a cross-sectional view of the crane jib system of FIG. 1 showing the telescoping cylinder extending the auxiliary jib.

FIG. 4 shows how the telescoping cylinder 2 still further has moved to the right on its piston 5, and therein shifts outwardly the innermost telescopic part 13 of the auxiliary jib 11 locked with the locking unit 4. It will do this up to a point, where the telescopic part 13 with its locking portion 12 has arrived at a location at which it can be attached to the second innermost telescopic part 14 in the steel construction. If this attachment of the telescopic part 13 to the telescopic part 14 (in the front region thereof) has occurred, the locking unit 4 can release its engagement.

Figure 5:
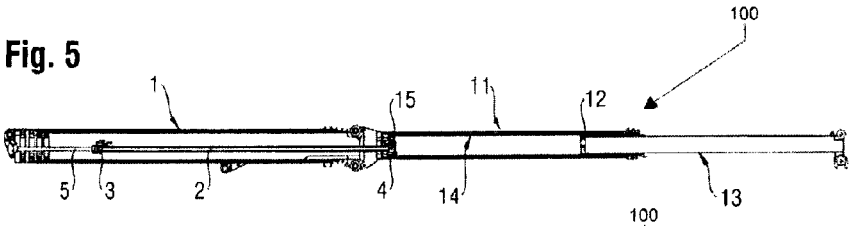
FIG. 5 is a cross-sectional view of the crane jib system of FIG. 1 showing the telescoping cylinder being retracted while the auxiliary jib remains extended.
Figure 6:
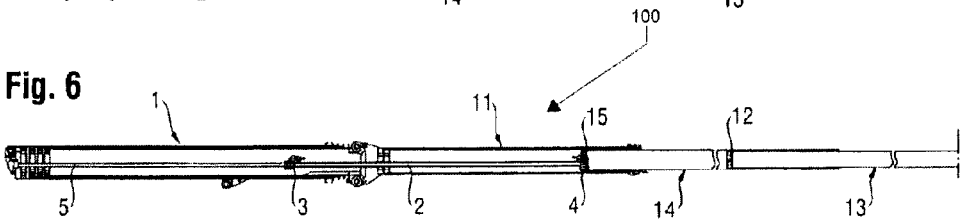
FIG. 6 is a cross-sectional view of the crane jib system of FIG. 1 showing the telescoping cylinder extending another portion of the auxiliary jib.

FIG. 5 shows the state after this step, in which the telescoping cylinder 2 has again been retracted to the left until the second locking unit 4 is located at the level of the lower locking unit portion 15 of the innermost telescopic part 14 of the auxiliary jib 11 shown in FIGS. 4 and 5. There, it will again bring about locking according to the above shown principle in order to then telescope out also the telescopic section 14 by moving the telescoping cylinder 2 to the right, until it can again be locked in the steel construction of the next outer telescopic part. This state is apparent from FIG. 6, and it should be clear that the telescoping out of all of the sections can be effected according to this principle.

According to the invention, thus, the auxiliary jib 11 has been extended only with the aid of the telescoping cylinder 2 of the main jib 1 as described above. The telescoping cylinder 2 of the main jib 1 is able to extend the auxiliary jib 11 solely due to the second locking unit 4 mounted to the upper part of the telescoping cylinder 2. According to the invention, thus, an auxiliary jib 11 is mounted in front of the main jib 1, in particular an auxiliary jib 11 without its own telescoping means, but nevertheless having the possibility of extending and retracting the telescopic sections.

After the auxiliary jib has been telescoped out as far as desired, by means of the crane jib system or telescoping system according to the invention, the main jib can also be telescoped in order to achieve a large range and height, respectively. To this, in FIG. 7 it is illustrated how the telescoping cylinder 2 is moved to the left as far as it engages with the first locking unit 3 with the portion of application 8 of the innermost telescope 7 of the main jib 1 and thereby locks this telescope such that it can be moved outwardly with the telescoping cylinder 2, as is shown in FIG. 8. This is also effected until the portion of application 8 is at a point where it can be locked or attached at the front in the steel construction of the second innermost telescopic part of the main jib 1. Then, the locking of the telescopic part 7 can be released by the locking unit 3, the telescopic cylinder 2 retracts and fetches the next telescopic part of the main jib 1. Further telescoping out is effected in corresponding manner and the telescoping in will be effected in reversed manner and therefore does not have to be discussed in detail here.

Figure 7:
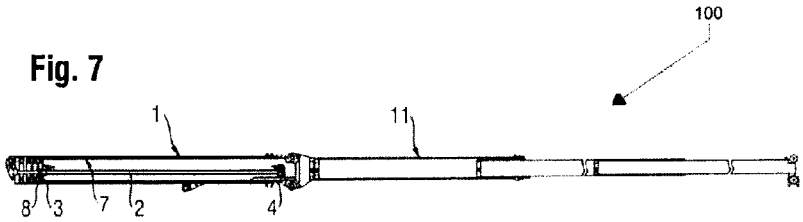
FIG. 7 is a cross-sectional view of the crane jib system of FIG. 1 showing the telescoping cylinder being retracted while the auxiliary jib remains extended.
Figure 8:
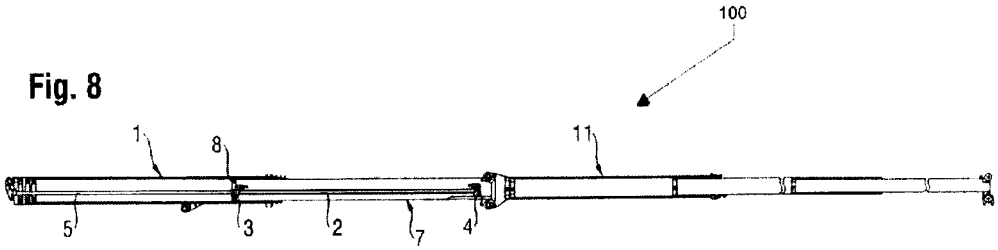
FIG. 8 is a cross-sectional view of the crane jib system of FIG. 1 showing the telescoping cylinder extending the main jib.
Figure 9:
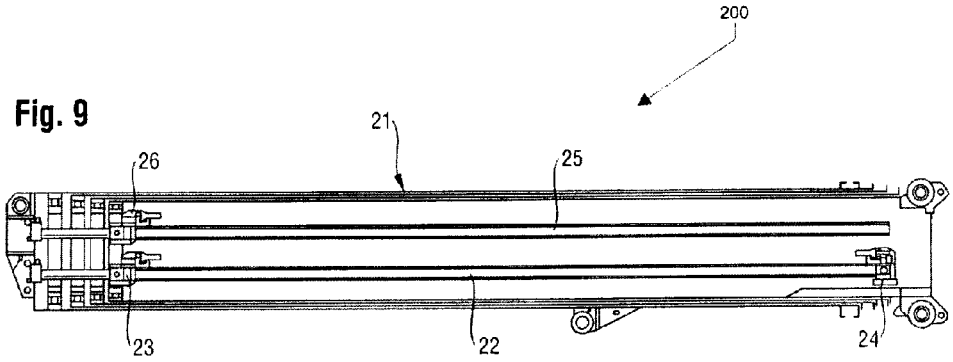
FIG. 9 is a cross-section diagram of an embodiment of a crane jib system having two telescoping cylinders.

From the illustrations of the entire telescopic jib with extended sections in FIGS. 7 and 8, it becomes clear that the entire crane jib can be relatively light in its upper region because a telescoping system for the auxiliary jib does not have to be present. Thereby, range and payload are increased with a self-telescoping system, which allows simple handling in the field.

In FIG. 9, an embodiment of a telescoping system according to the invention is shown, which has a plurality of telescoping cylinders, in particular two telescoping cylinders. For explanation, only the illustration of the arrangement in the main jib 21 is required, where the telescoping cylinders 22 and 25 are disposed one above the other. Therein, the telescoping cylinder 22 is a telescoping cylinder as it has already been discussed above, with two locking units 23 and 24 on the base as well as at the upper end. The telescoping cylinder 25 has only one locking unit 26 on its base. This embodiment of the present invention is in particular advantageous if large forces have to be applied upon telescoping out the main jib. Namely, in this case, the main jib can be telescoped out concurrently with the cylinder 22 and 25, wherein the locking units 23 and 26 on the base each are employed. In order to be able to apply the large forces, the locking cylinder 25 can in particular be configured with the single locking unit 26 as a larger cylinder or with greater force effect.

As already described above, the telescoping cylinder 22 can be used for telescoping the auxiliary jib. A special advantage results if—as already indicated above—a relatively large cylinder with only one locking unit is provided for telescoping out the main jib, but which possibly cannot be moved into the auxiliary jib due to lack of space. Then, a smaller telescoping cylinder 22 can be used, which readily can be moved into the auxiliary jib and also should be sufficient for telescoping the auxiliary jib due to its smaller dimensions

What is claimed is:

1. A crane jib system comprising:

a main jib comprised of main telescoping portions;

an auxiliary jib detachably attached to the main jib, the auxiliary jib comprised of auxiliary telescoping portions;

a telescoping cylinder having a first telescopic part locking unit disposed on a base portion of the telescoping cylinder, the first telescopic part locking unit adapted to selectively engage the main telescoping portions, and a second telescopic part locking unit disposed on the telescoping cylinder above the first telescopic part locking unit, the second telescopic part locking unit adapted to selectively engage the auxiliary telescoping portions.

2. The crane jib system according to claim 1 wherein the second telescopic part locking unit is disposed on an upper portion of the telescoping cylinder.

3. The crane jib system according to claim 1 wherein the telescoping cylinder has a region opposite the base portion, and wherein the second telescopic part locking unit is disposed on the region opposite the base portion.

4. The crane jib system according to claim 1 wherein the second telescopic part locking unit is disposed on an upper end of the telescoping cylinder.

5. The crane jib system according to claim 1 wherein the crane jib system has only a single telescoping cylinder.

6. The crane jib system according to claim 1 wherein the crane jib system further comprises a second telescoping cylinder.

7. The crane jib system according to claim 6 wherein the second telescoping cylinder has a single locking unit adapted to engage the main telescoping portions.

8. The crane jib system according to claim 7 wherein the second telescopic part locking unit is adapted to telescope the auxiliary jib in and out.

9. The crane jib system according claim 8 wherein a reachability of the auxiliary jib and an achievable telescoping distance for the auxiliary jib is determined by a characteristic selected from the group consisting of a length of the telescoping cylinder and a position of the second telescoping part locking unit relative to an upper end of the telescoping cylinder.

10. The crane jib system according to claim 8 wherein an upper end of the telescoping cylinder extends up to an upper end region of the main jib in its retracted state.

11. The crane jib system according to claim 8 wherein the auxiliary jib is attached to a luffing jib pivot point of a head of the main jib.

12. The crane jib system of claim 1 wherein a passage is provided in a connection region between the main jib and the auxiliary jib, through which an upper portion of the telescoping cylinder having the second telescopic part locking unit attached thereto can move into the auxiliary jib.

13. The crane jib system according to claim 1 wherein the main jib has a main lower collar region and the auxiliary jib has an auxiliary lower collar region, and wherein a first locking unit is adapted to engage the main lower collar region and a second locking unit is adapted to engage the auxiliary lower collar region.

14. A crane jib telescoping system for a telescopic crane jib having a telescopic main jib comprised of main telescoping portions and a telescopic auxiliary jib detachably attached to the main jib compromised of auxiliary telescoping portions, the crane jib telescoping system comprising:

a telescoping cylinder having a first telescopic part locking unit disposed on a base portion of the telescoping cylinder, the first telescopic part locking unit adapted to selectively engage the main telescoping portions, and a second telescopic part locking unit disposed on the telescoping cylinder above the first telescopic part locking unit, the second telescopic part locking unit adapted to selectively engage the auxiliary telescoping portions.

15. The crane jib telescoping system according to claim 14 wherein the second telescopic part locking unit is disposed on an upper portion of the telescoping cylinder.

16. The crane jib telescoping system according to claim 14 wherein the second telescopic part locking unit is disposed on the telescoping cylinder in a region opposite the base portion.

17. The crane jib telescoping system according to claim 14 wherein the second telescopic part locking unit is disposed on an upper end of the telescoping cylinder.

18. The crane jib telescoping system according to claim 14 wherein the crane jib telescoping system has only a single telescoping cylinder.

19. The crane jib telescoping system according to claim 14 wherein the crane jib telescoping system further comprises a second telescoping cylinder.

20. The crane jib telescoping system according to claim 19 wherein the second telescoping cylinder has a single locking unit adapted to engage the main telescoping portions.

* * * * *